US006138700A

United States Patent [19]

Stoddart

[11] Patent Number: 6,138,700

[45] Date of Patent: Oct. 31, 2000

[54] WIND SHELTER

[76] Inventor: Lorne D. Stoddart, 1505 Charleswood Rd., Winnipeg, Canada, R2S 1C2

[21] Appl. No.: 09/219,511

[22] Filed: Dec. 23, 1998

[30] Foreign Application Priority Data

Dec. 30, 1997 [CA] Canada ..... 2225981

[51] Int. Cl.[7] ..... E04H 17/00

[52] U.S. Cl. ..... 135/87; 135/116; 135/119

[58] Field of Search ..... 135/116, 119

[56] References Cited

U.S. PATENT DOCUMENTS

| | | | |
|---|---|---|---|
| 3,404,696 | 10/1968 | Filho | 135/902 |
| 4,286,612 | 9/1981 | Neal | 135/116 |
| 4,821,353 | 4/1989 | Neri | 135/116 |
| 4,860,777 | 8/1989 | Orlando | 135/902 |
| 4,966,181 | 10/1990 | Liberman | 135/902 |
| 4,969,500 | 11/1990 | Makosa | 135/902 |
| 4,981,152 | 1/1991 | Laurent | 135/900 |
| 5,010,909 | 4/1991 | Cleveland | 135/119 |
| 5,080,123 | 1/1992 | Stein | 135/900 |
| 5,711,336 | 1/1998 | Nirmel | 135/116 |
| 5,937,883 | 8/1999 | Camara | 135/902 |

*Primary Examiner*—Beth A. Stephan

*Attorney, Agent, or Firm*—Murray E. Thrift; Adrian D. Battison; Michael R. Williams

[57] ABSTRACT

A wind shelter particularly useful for sunbathing on a beach has a floor and wedge-shaped wall that extends along two sides and across the back. The wall is supported by a frame extending around the top edge of the wall and upright support rods holding the frame away from the floor to stretch the side wall to a vertical orientation.

12 Claims, 5 Drawing Sheets

WIND SHELTER

FIELD OF THE INVENTION

The present invention relates to wind shelters and more particularly to a wind shelter suitable for use when sunbathing.

BACKGROUND

Conventional sunbathing, lying on a towel on a beach, can be accompanied by certain discomforts and disadvantages. For example, even a light wind can produce a noticeable chill, especially if the sunbather is wet from swimming. Wind can blow sand, dust and debris onto the sunbather, and it can blow away papers, magazines and picnic supplies. The blankets and towels used when swimming and sunbathing often accumulate significant quantities of sand and dirt. This not only creates a laundry problem but also may bring the sand and dirt into an automobile or the home.

SUMMARY

The present invention is concerned with a shelter that can ameliorate these discomforts and disadvantages and provide a number of other advantages as will become apparent from the following description.

According to the present invention there is provided a wind shelter comprising:

- a floor panel of foldable material with spaced apart sides and spaced apart back and front ends extending between the sides;
- a wall of foldable material extending across the back and along the sides of the floor, and secured to the floor; and
- a wall support including a frame connected to a top edge of the wall and supports supporting the frame above the floor.

The shelter can be set up with the back end facing into an ambient wind, sheltering the floor on the leeward side from the wind. Because the shelter has a full floor, it protects the users and their blankets and towels from dampness, sand, dirt and insects. It provides a sheltered area for picnic supplies, newspapers and magazines as well as for sunbathing. Children may use the shelter as a play or rest area, out of the wind and out of the way of passersby.

In preferred embodiments, the floor and wall are flaccid, made for example from plastic sheet material or a suitable textile fabric. The preferred floor is a resin impregnated fabric of the type used for tarpaulins and tent floors. The preferred wall material is a woven nylon fabric of the type used for tents.

The wall panel preferably tapers in height from the back end to the front so that the shelter has an overall wedge shape.

The frame may be a resilient rod engaged in a sleeve along the top of the wall, providing the shelter with a rounded U-shape that is both functional and attractive. An alternative arrangement uses two side rods and a back rod meeting at corners at the back end of the shelter.

BRIEF DESCRIPTION OF THE DRAWINGS

In the accompanying drawings, which illustrate exemplary embodiments of the present invention.

DETAILED DESCRIPTION

Figure 1:
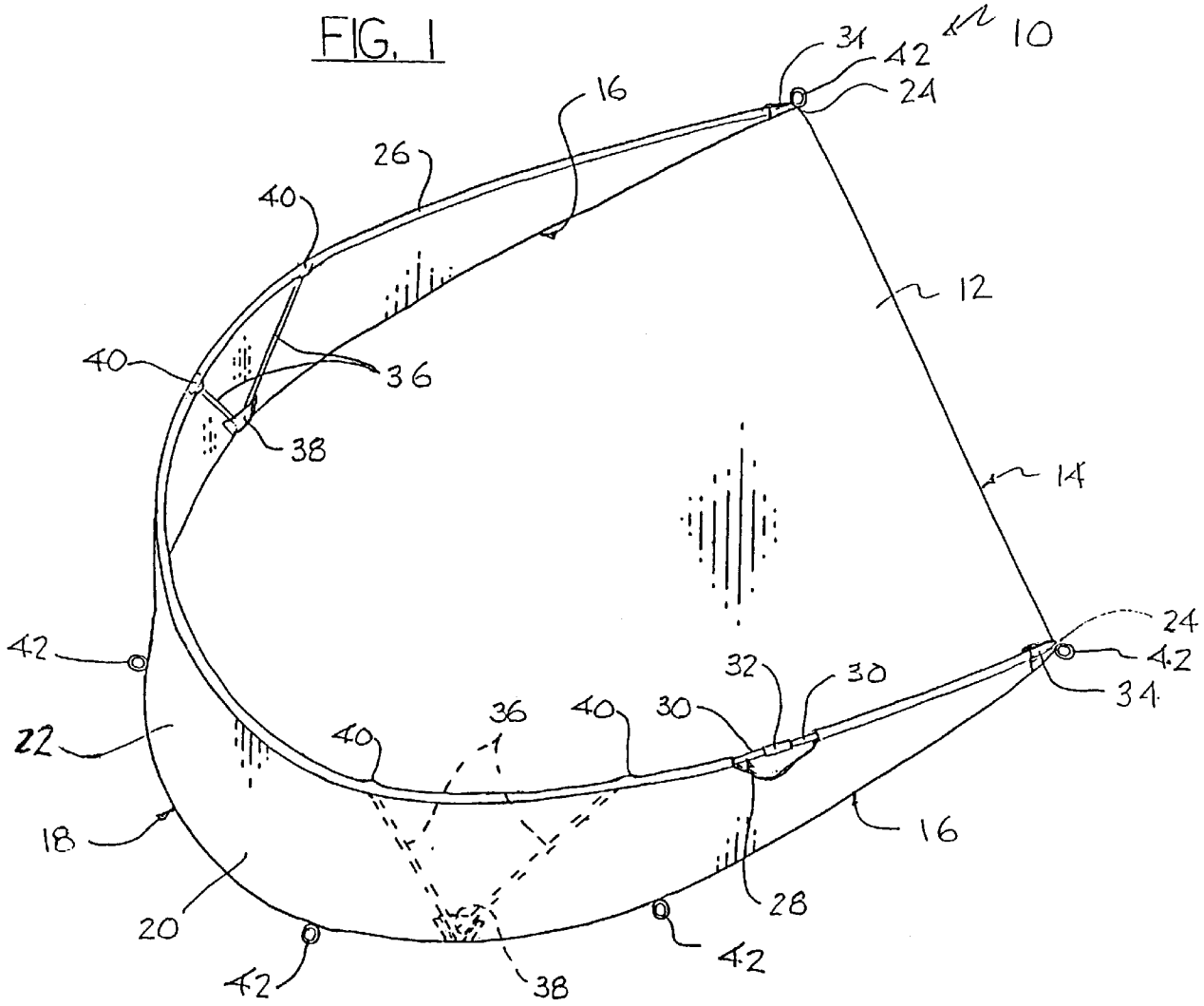
FIG. 1 is an isometric view of one embodiment of the present invention.
Figure 2:
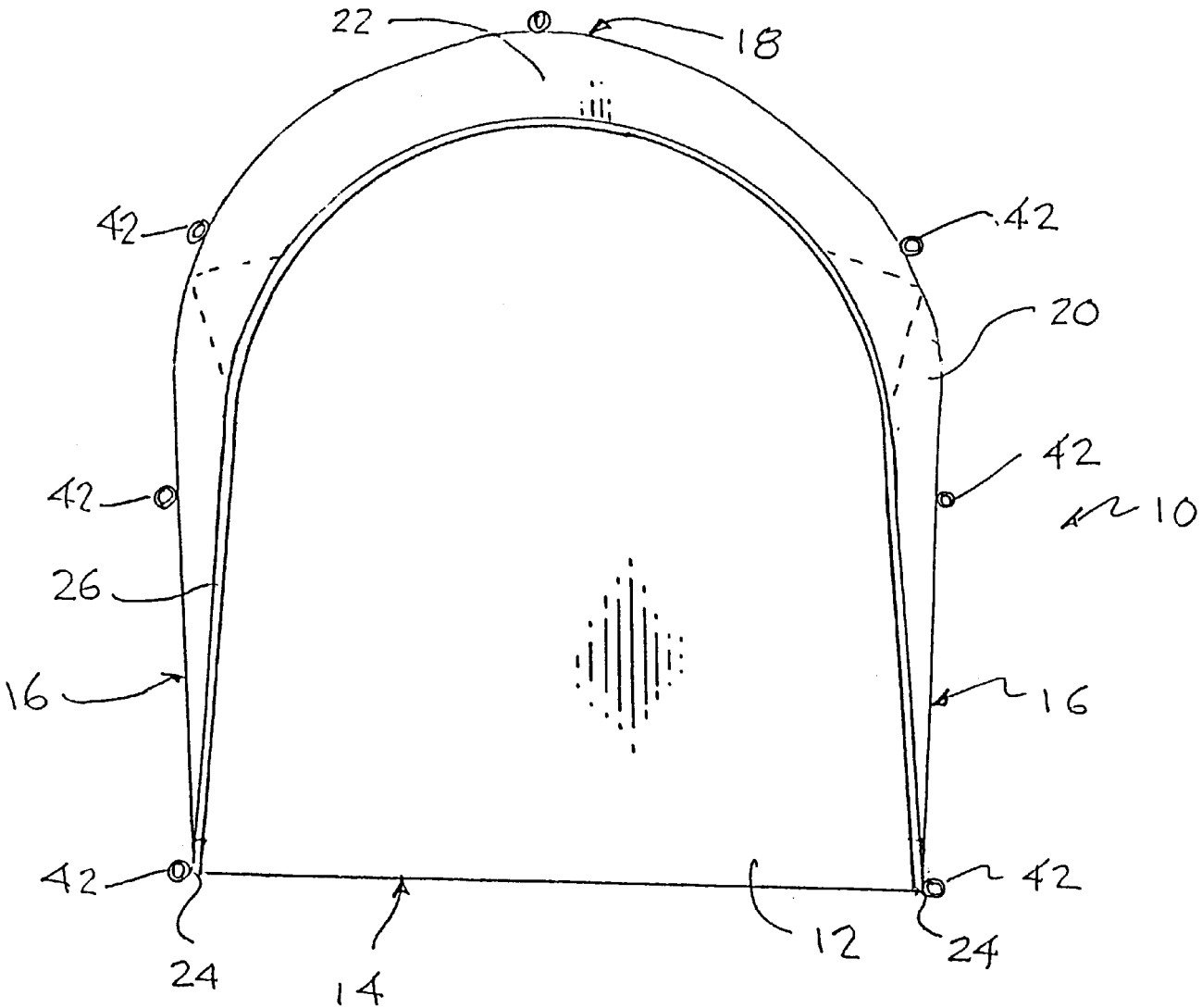
FIG. 2 is a plan view of the embodiment of FIG. 1.
Figure 3:
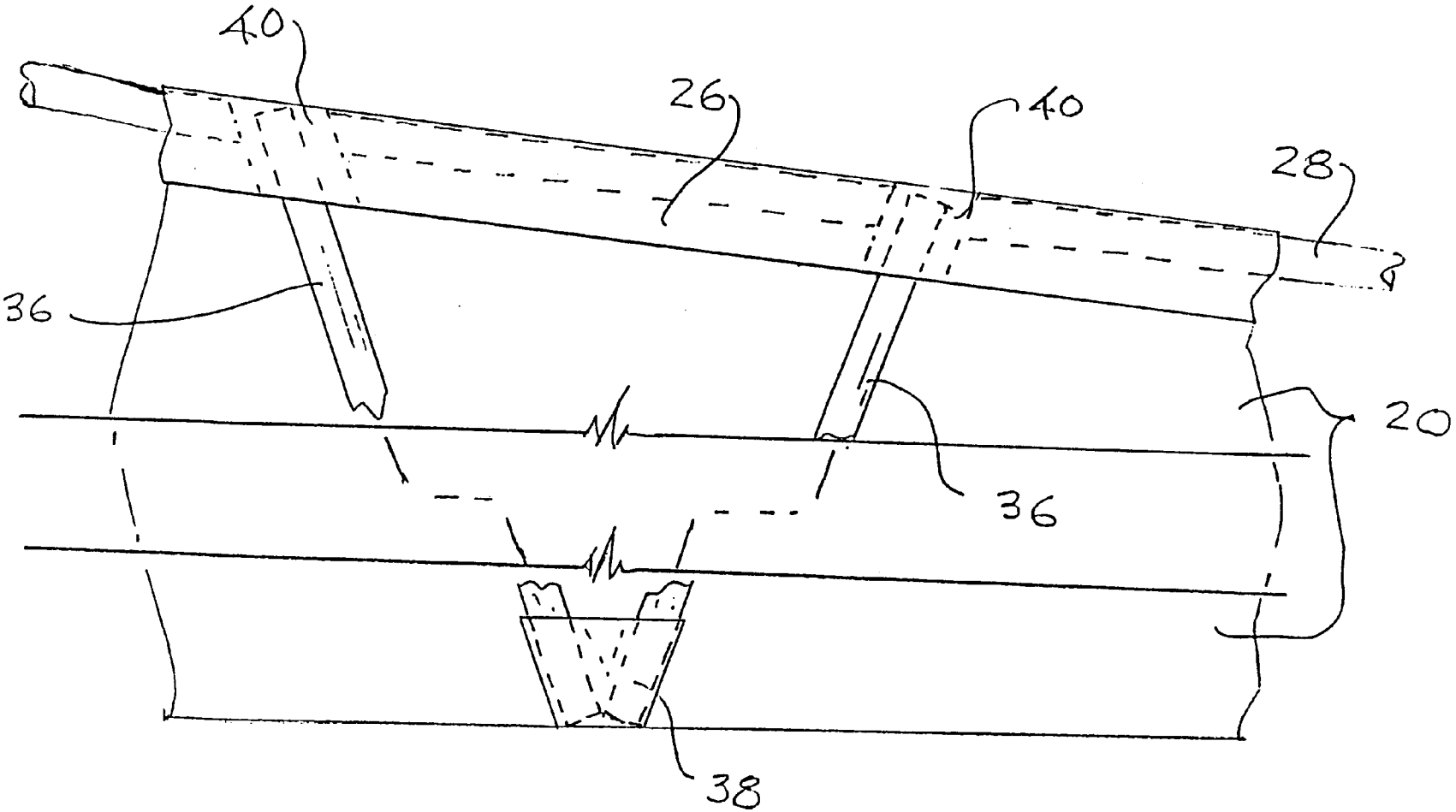
FIG. 3 is a detail view showing the mounting of the support rods.

Referring to the accompanying drawings, and especially to FIGS. 1, 2 and 3, there is illustrated a wind shelter 10 with a floor 12 of a flaccid, waterproof material. The floor has a front end 14, opposite sides 16 and a curved back end 18. A wall 20 extends along the sides and around the back of the floor. A bottom edge of the wall is fastened to the floor. The wall tapers in height from a maximum height at the middle of the back end 22 to the front corners 24 of the floor, giving the shelter an overall wedge-shape. The wall is made of a flaccid, windproof material, in this case a woven nylon textile fabric.

Along the top edge of the wall 20 is a sleeve 26. This extends along the sides and around the back and receives a fiber-reinforced resin rod 28. The rod is normally straight and is resiliently bowed into a U-shaped configuration to produce a lateral tension stretching the shelter open laterally. The rod 28 is formed of a series of rod segments 30 coupled end-to-end by connector sleeves 32. At the front end of the shelter, the ends of the rod are fitted into pockets 34 fastened to the floor of the shelter. The rod and wall are sized relative to the floor such that the wall slopes inwardly towards the top.

The wall is maintained stretched vertically by a set of four upright support rods 36, two on each side of the shelter. The two rods on each side are arranged in a V-shape with their bottom ends engaged in a pocket 38 at the bottom edge of the wall. At the top edge of the wall, the rods are engaged in respective pockets 40.

Spaced along the bottom edge of the floor panel are loops 42 to be engaged by hold-down pegs.

Because this shelter is made from flaccid materials, it may be transported in a collapsed, folded condition, with the rod 28 dismantled and the complete shelter packed into a very small, lightweight package. To erect the shelter, it is a simple matter to unfold the floor and wall, to thread the rod 28 through the sleeve 26 and then to insert the four support rods 36. The floor may be pegged down either before or after the rod 28 and the support rods are installed.

Figure 4:
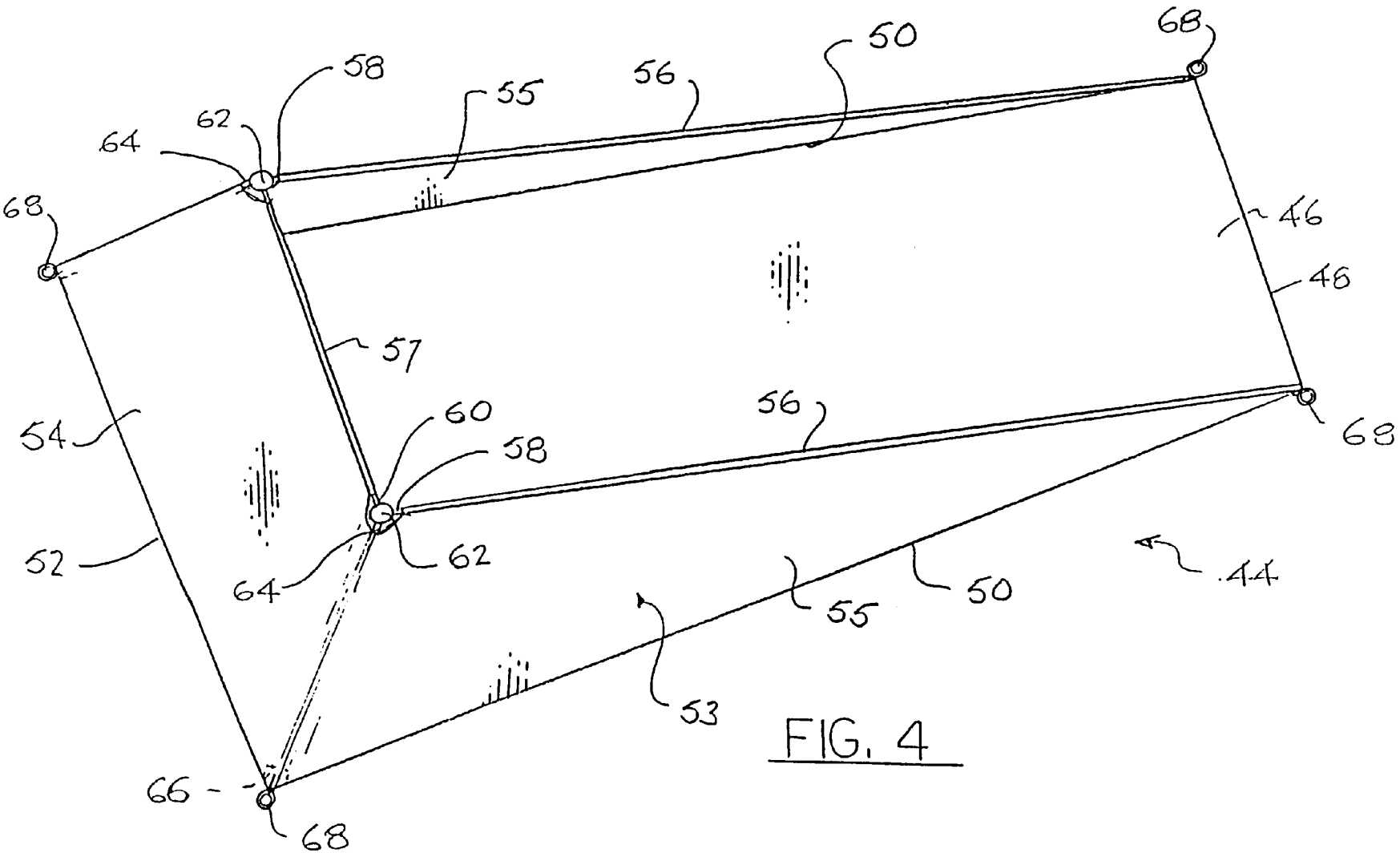
FIG. 4 is an isometric view of an alternative embodiment of the present invention.
Figure 5:
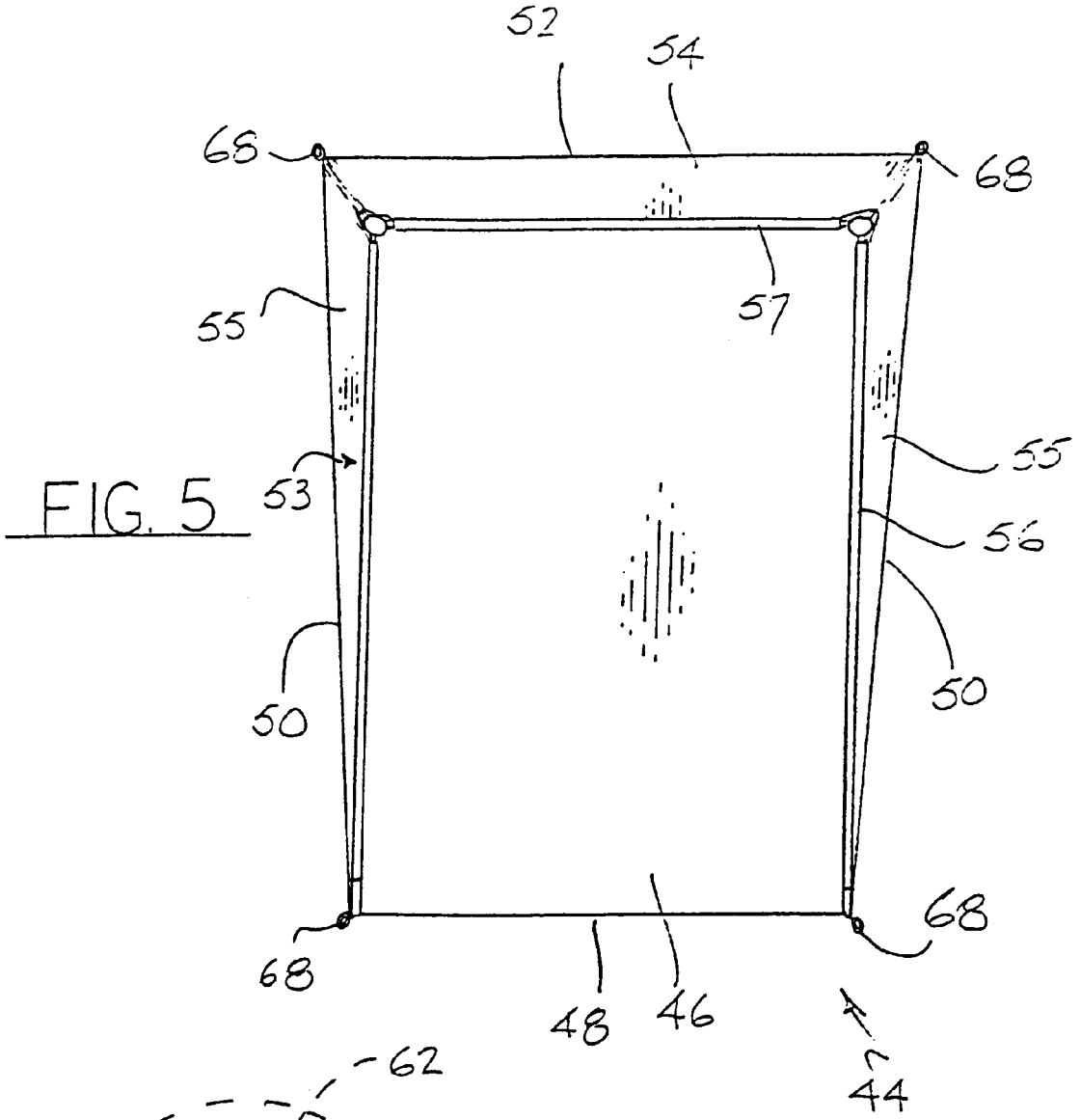
FIG. 5 is a plan view of the embodiment of FIG. 4.
Figure 6:
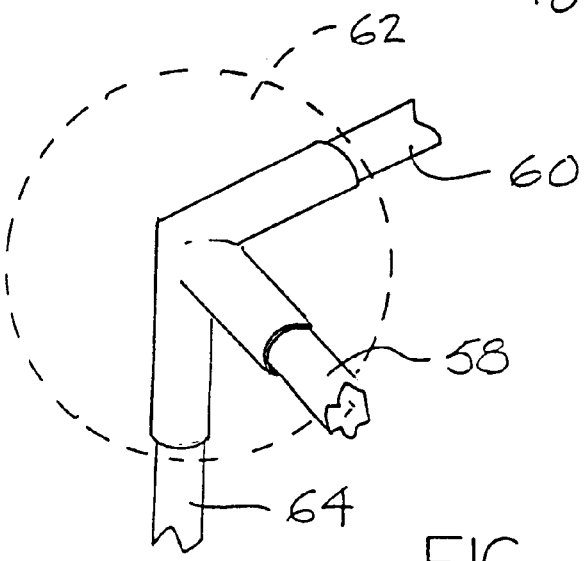
FIG. 6 is a detail view showing a back corner of the embodiment of FIGS. 4 and 5.

An alternate embodiment of the invention is illustrated in FIGS. 4, 5 and 6. In this embodiment, the shelter 44 has a generally rectangular floor 46 with a front end 48, two sides 50 and a back end 52. The wall 53 has a trapezoidal back panel 54 and two triangular side panels 55. Two sleeves 56 extend along the top edges of the side panels 55, while a similar sleeve 57 extends along the top edge of the back panel 54. The frame for the shelter includes two side rods 58 that extend through the side sleeves and a back rod 60 that extends through the back sleeve 57. The rods are joined by couplings 62, each with two sockets for an end of the back rod and an end of the associate side rod. In this embodiment there are two support rods, 64 each of which engages a third socket in one of the couplings 62 and extends along the inside of the wall to a pocket 66 at the back corner of the floor. Four hold-down loops 68 are used, at the corners of the floor panel.

Setting up the second embodiment of the invention is similar to setting up the embodiment of FIG. 1 through 3. In this case the three rods that compose the frame are threaded through their respective sleeves and connected using the corner couplings 62.

While particular embodiments of the invention have been described in the foregoing, it is to be understood that other embodiments are possible within the scope of the invention and are intended to be included herein. The invention is to be considered limited solely by the scope of the appended claims.

What is claimed is:

1. A wind shelter comprising:

a floor panel of foldable material with spaced apart sides and spaced apart back and front ends extending between the sides;

a wall of foldable material extending across the back and along the sides of the floor and secured to the floor;

a wall support frame connected to a top edge of the wall, the frame comprising an elongate, resilient rod resiliently bowed into a U-shape; and supports supporting the frame above the floor.

2. A shelter according to claim 1 wherein the floor and wall are made from a flaccid material.

3. A shelter according to claim 1 wherein the rod comprises a plurality of rod segments and connectors for connecting the segments end-to-end.

4. A shelter according to claim 1 wherein the supports comprise upright support rods.

5. A shelter according to claim 1 including a sleeve extending along the top edge of the wall, with the rod extending along the sleeve.

6. A shelter according to claim 5 wherein the supports comprise upright support rods.

7. A shelter according to claim 6 including support rod pockets at the top edge of the side wall and at the floor for engaging ends of the support rods.

8. A shelter according to claim 1 wherein the wall tapers in height from the back end to the front end of the floor.

9. A wind shelter comprising:

a floor panel of foldable material with spaced apart sides and spaced apart back and front ends extending between the sides;

a wall of foldable material extending across the back and along the sides of the floor and secured to the floor;

a wall support frame connected to a to edge of the wall, the frame comprising two side rods, a back rod and corner couplings connecting the side rods to the back rod; and supports supporting the frame above the floor.

10. A shelter according to claim 9 including a plurality of sleeves extending along the top edge of the wall, the rods being engaged in the sleeves.

11. A shelter according to claim 9 wherein the supports comprise upright support rods.

12. A shelter according to claim 11 wherein the corner couplings connect the support rods to the frame.

* * * * *